United States Patent [19]

Mizumoto et al.

[11] 4,089,205

[45] May 16, 1978

[54] TRANSFER PRESS

[75] Inventors: Masakatsu Mizumoto, Kanazawa; Hisateru Yamashita, Komatsu, both of Japan

[73] Assignee: Kabushiki Kaisha Komatsu Seisakusho, Tokyo, Japan

[21] Appl. No.: 753,229

[22] Filed: Dec. 22, 1976

[30] Foreign Application Priority Data

Dec. 26, 1975 Japan ..... 50-175448[U]

[51] Int. Cl.[2] ..... B21J 9/18

[52] U.S. Cl. ..... 72/450; 72/455

[58] Field of Search ..... 72/404, 405, 450, 429, 72/455

[56] References Cited

U.S. PATENT DOCUMENTS

| | | | |
|---|---|---|---|
| 413,667 | 10/1889 | Hodgson | 72/405 |
| 1,136,558 | 4/1915 | Sherman | 72/405 |
| 2,102,842 | 12/1937 | Glasner | 72/450 |
| 3,130,699 | 4/1964 | Ward | 72/450 |
| 3,289,450 | 12/1966 | Clements | 72/267 |
| 3,557,600 | 1/1971 | Saito | 72/450 |
| 3,695,090 | 10/1972 | Kita | 72/450 |

FOREIGN PATENT DOCUMENTS

| | | | |
|---|---|---|---|
| 1,292,750 | 10/1972 | United Kingdom | 72/455 |

*Primary Examiner*—C.W. Lanham
*Assistant Examiner*—Gene P. Crosby
*Attorney, Agent, or Firm*—Armstrong, Nikaido, Marmelstein & Kubovcik

[57] ABSTRACT

A transfer press is disclosed including a bed, at least two slides, uprights and a crown. Driving means for the slides are accommodated within a plurality of driving chambers. Connecting rods are inserted within said uprights for tightly connecting said driving chambers with said bed. Each slide is actuated by a pair of connecting rods positioned diagonally adjacent to both ends thereof between forward and rearward members of the uprights for achieving uniform distribution of urging forces.

3 Claims, 2 Drawing Figures

TRANSFER PRESS

BACKGROUND OF THE INVENTION

This invention relates to a transfer press, and more particularly to a transfer press comprising at least two sets of slides arranged in series and adapted to drive the slides from the above by means of one set of clutch and brake.

In general, products finished by pressing or drawing cannot be completely finished by one step, and require a plurality of work processes such as piercing, bending and trimming etc. In order to effect such work processes by means of commonly used presses, it is substantially necessary to provide a number of presses equivalent to the number of work processes and replace molds frequently in plural sets of presses. Especially, as the production quantity increases, there arise various problems relating to arrangments and transports of semi-finished products, floor space therefor and intermediate annealing. To overcome such problems, there has been developed and employed a transfer press which enables work processes for finishing blanks into final products to be continuously effected by one set of press.

The conventionally employed transfer presses are disadvantageous in that means for driving and urging slides are accommodated in one or two driving chambers, and so there encounters some difficulties in uniform distribution of urging or pressing forces exerted on the slides.

In the Japanese patent publication No. 7545/1974, there is disclosed a transfer press wherein a plurality of slides can be driven by one set of clutch and brake and which is arranged such that heavy load work steps may be effected by presses having a large capacity, whilst light load work steps may be effected by presses having a small capacity.

SUMMARY OF THE INVENTION

It is, therefore, an object of the present invention to provide a transfer press wherein deflections of the driving chambers can be minimized.

Another object of the present invention is to provide a transfer press wherein a plurality of driving means for slides can be driven by a single motor.

It is still further object of the present invention to provide a transfer press wherein the inclination of the slide due to eccentric loads exerted on said slide can be substantially reduced.

According to the present invention, there is provided a transfer press comprising a bed, at least two sets of slides arranged in series above said bed, a plurality of driving means for driving said slides, a plurality of driving chambers for accommodating said driving means, said driving means being interconnected by frame means, a plurality of uprights for interconnecting said bed and said driving chambers, a plurality of tie rods inserted within said uprights for connecting said chambers with said bed, and a single motor for driving said driving means wherein said slides are adapted to be urged in the positions adjacent to both ends thereof by connecting said driving means with said slides via connecting rods.

Other objects, features and advantages of the present invention will be readily apparent from the following description taken in conjunction with the accompanying drawings.

DETAILED DESCRIPTION OF THE PREFERRED EMBODIMENT

Figure 1:
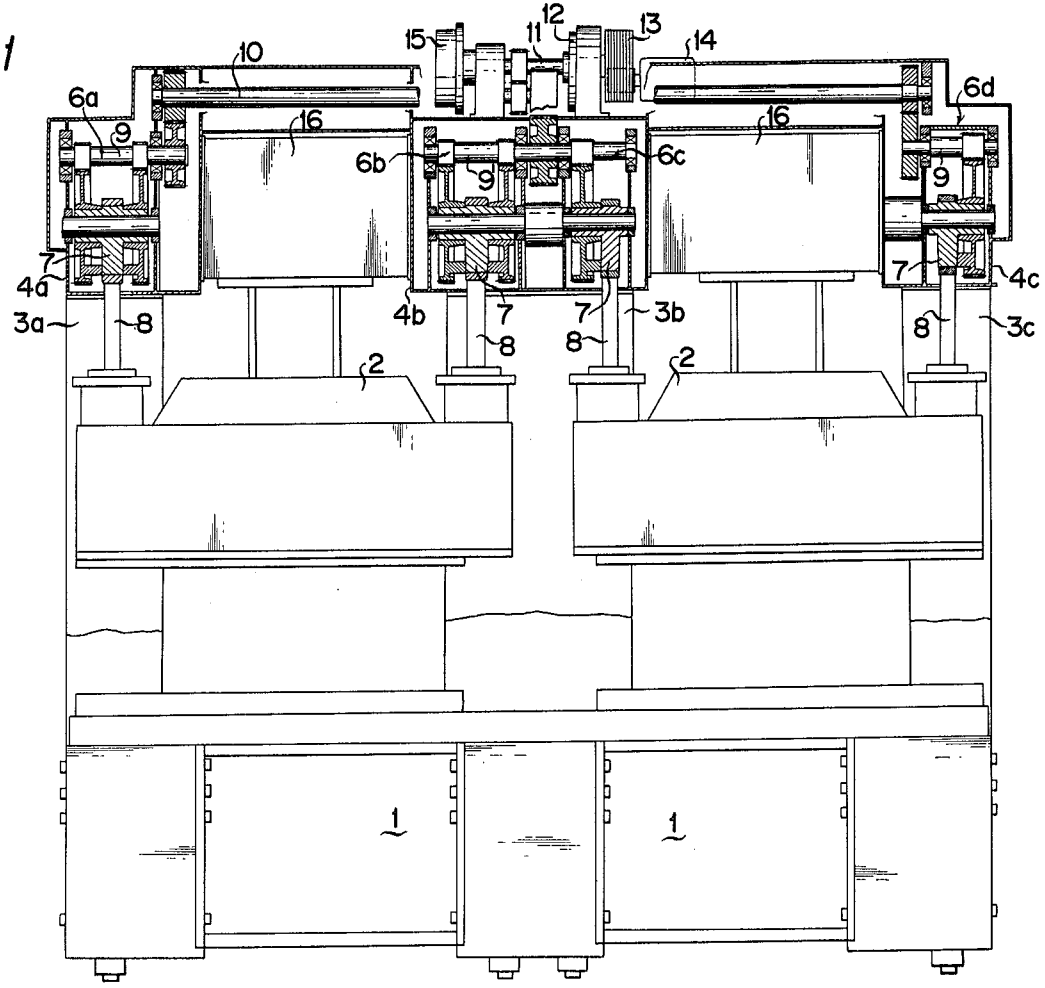
FIG. 1 is a front elevation partially in cross-section of the present invention.
Figure 2:
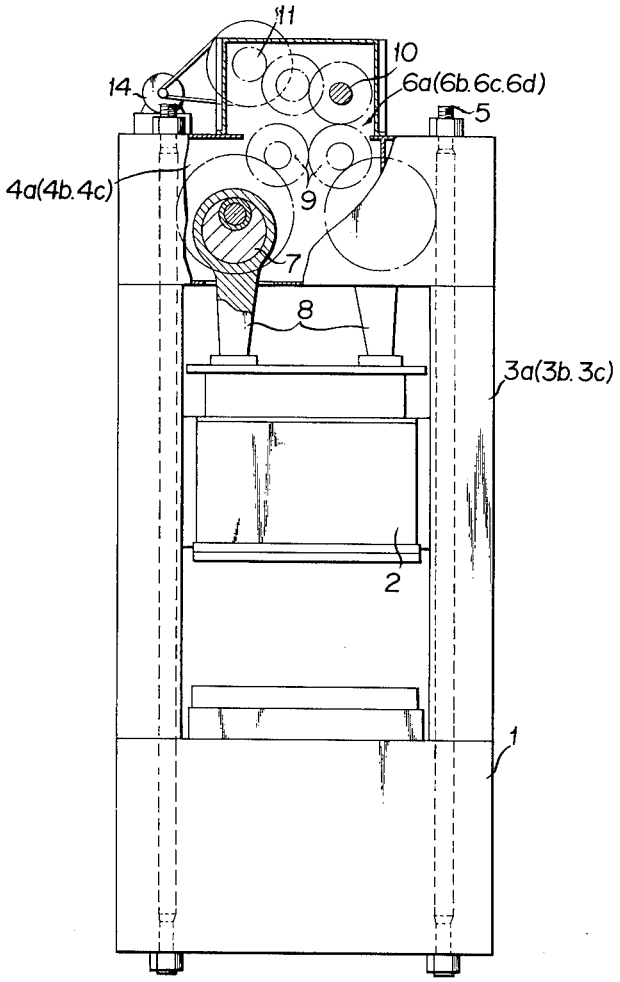
FIG. 2 is a side view partially in cross-section of the present invention.

In the drawings, reference numeral 1 denotes bed which comprises a plurality of bed constituent members assembled in an integral unit by means of bolts, but which may be constructed integrally from the first. Reference numeral 2—2 denote a plurality of slides, both sides of which are engaged with uprights 3*a*, 3*b* and 3*c*. Out of the uprights 3*a*, 3*b* and 3*c*, the upright 3*b* which guides and engages with both of the adjacent slides 2, 2 is constructed in an integral unit to have a large width.

Reference numeral 4*a*, 4*b* and 4*c* represent driving chambers located, respectively, on the upper ends of the uprights 3*a*, 3*b* and 3*c*. The driving chambers 4*a*, 4*b* and 4*c*, the uprights 3*a*, 3*b* and 3*c* and the bed 1, are vertically interconnected by means of a plurality of tie rods 5. Mounted within the driving chambers 4*a*, 4*b* and 4*c* are driving means 6*a*, 6*b*, 6*c* and 6*d* which are connected with the end portions of the slides 2, 2, respectively.

Reference numeral 7 denotes an eccentric drum, and 8 a connecting rod which connects the eccentric drum 7 with the slide 2. The eccentric drum 7 is connected through a gear with a driving shaft 9. Mounted within the driving chamber 4*b* located adjacent to both of the slides 2, 2 are the driving means 6*b* and 6*c* connected, respectively, with the end portions of the slides 2, 2. The driving means 6*b* and 6*c* have a common driving shaft 9' connected thereto. The above-mentioned driving shafts 9, 9 and 9' of the driving means 6*a*, 6*b*, 6*c* and 6*d* are connected with a single power distribution or transmission shaft 10. The power distribution shaft 10 is connected with a clutch brake shaft 11 which is coaxially connected through a flywheel 12 and a clutch 13 with a driving motor 14. The above-mentioned driving chambers 4*a*, 4*b* and 4*c* are interconnected by frames 16, 16.

In operation, the single driving motor 14 is energized so that the power developed by the motor may be transmitted through the power distribution shaft 10 to the driving shafts 9, 9 and 9' of the driving means 6*a*, 6*b*, 6*c* and 6*d* so as to drive the latter thereby permitting the slides 2, 2 to slide synchronously.

As described hereinabove, the present invention provides a large sized transfer press comprising at least two slides 2, 2 arranged in series and adapted to urge and drive the slides from the above by means of one set of clutch 13 and brake 15, wherein the slides 2, 2 are adapted to be urged in positions adjacent to both ends thereof and the driving means 6*a*, 6*b*, 6*c* and 6*d* connected to the portions of the slides to be urged are constructed independently and accommodated in the driving chambers 4*a*, 4*b* and 4*c*, respectively, which are formed separately from the uprights 3*a*, 3*b* and 3*c*. Further, according to the present invention, the driving chambers 4*a*, 4*b* and 4*c*, the uprights 3*a*, 3*b* and 3*c* and the bed 1, are connected vertically by means of the tie rods 5 and the driving chambers 4*a*, 4*b* and 4*c* interconnected by means of the frames 16, 16 so as to form a large sized transfer press. Accordingly, not only the driving chambers can be reduced in size and manufactured so easily, but also because of the portions of the slides to be urged and the the rods 5 being located closer the deflection of the driving chambers which tends to occur when urging forces are exerted on the slides can be minimized, and further the inclination of the slides due to the eccentric load can be reduced so that the slides can be located in accurate parallel relationship. Further, when it is desired to increase the number of the slides 2, it is necessary only to increase the number of the driving chambers and interconnect them.

It is to be understood that the foregoing description is merely illustrative of the preferred embodiment of the present invention and that the scope of the invention is not to be limited thereto, but is to be determined by the scope of the appended claims.

What is claimed is:

1. A transfer press comprising:

a bed;

at least two slides arranged in series above said bed;

a plurality of driving means for driving said slides;

a plurality of driving chambers for accommodating said driving means;

frame means for interconnecting said driving chambers;

a plurality of pairs of uprights for interconnecting said bed and said driving chambers, each of said pairs of uprights comprising a forward and a rearward upright element;

a connecting rod means being provided for each said slide, each connecting rod means comprising a pair of connecting rods, said connecting rods being connected adjacent opposite ends of each said slide and being arranged between said pairs of uprights for connecting said driving means and said slides, so as to urge each of said slides adjacent to both ends thereof for achieving uniform distribution of urging forces and avoiding inclination of said slides to be urged relative to said bed;

a plurality of tie rods inserted within said uprights for connecting said chambers with said bed; and a single motor means for driving all of said driving means simultaneously.

2. A transfer press according to claim 1 wherein the number of said driving chambers is $(n+1)$, where the number of slides is $n$.

3. A transfer press according to claim 2 wherein one said driving chamber is located on each of the ends of the press and each accommodates one set of driving means, whilst intermediate driving chambers accommodates two sets of driving means.

* * * * *